US005737777A

United States Patent [19]

Hilleary

[11] Patent Number: 5,737,777

[45] Date of Patent: Apr. 14, 1998

[54] HELMET STRAP ASSEMBLY HAVING CONTOURED SUPPORT MEMBER

[76] Inventor: Alan J. Hilleary, 2100 Electric Ave., #317, Bellingham, Wash. 98226

[21] Appl. No.: 739,589

[22] Filed: Oct. 30, 1996

[51] Int. Cl.[6] ..... A42B 3/00

[52] U.S. Cl. ..... 2/421; 2/425

[58] Field of Search ..... 2/421, 425, 410, 2/411, 422, 267

[56] References Cited

U.S. PATENT DOCUMENTS

| | | | |
|---|---|---|---|
| 1,855,795 | 4/1932 | Dorsey . | |
| 3,311,921 | 4/1967 | Helm | 2/425 |
| 3,572,329 | 3/1971 | Woskin . | |
| 3,619,813 | 11/1971 | Marchello | 2/421 |
| 4,646,368 | 3/1987 | Infusino et al. | 2/425 |
| 4,651,356 | 3/1987 | Zide . | |
| 4,741,054 | 5/1988 | Mattes | 2/422 |
| 4,856,119 | 8/1989 | Haberle . | |
| 4,884,301 | 12/1989 | Aileo | 2/421 |
| 5,347,660 | 9/1994 | Zide et al. | 2/425 |
| 5,459,878 | 10/1995 | Gold . | |
| 5,500,951 | 3/1996 | Marchello . | |
| 5,504,945 | 4/1996 | Purnell . | |

*Primary Examiner*—Gloria Hale
*Attorney, Agent, or Firm*—Todd N. Hathaway

[57] ABSTRACT

A chin strap assembly incorporating a semi-rigid, flexible support member formed of plastic or other resilient material and having upwardly extending end portions which bear upwardly against first and second sides of the wearer's jawbone, and a downwardly arched center portion which relieves the soft-tissue, hypoglossal area of the throat from upward pressure generated by tension on the helmet strap thereby rendering it easier for the wearer to breath under exertion. A fabric wrap fits over the strap and support members to hold the latter in place at the desired location, and the wrap also provides cushioning for the wearer's jaw.

20 Claims, 3 Drawing Sheets

HELMET STRAP ASSEMBLY HAVING CONTOURED SUPPORT MEMBER

BACKGROUND

1. Field of the Invention

The present invention relates generally to protective head gear, and more particularly to a semi-rigid, flexible support member which is attached to the chin strap of a bicycle helmet or other protective headgear so as to relieve pressure against the underside of the wearer's jaw and tongue area, thereby making it easier for the wearer to breath during heavy exertion.

2. Background Art

Protective headgear, such as helmets, are commonly worn for many types of athletic or physical activities. In particular, helmet usage has become nearly universal amongst bicyclists, especially in any form of competition or strenuous riding.

In most conventional bicycle helmets and similar headgear, the cranial shell is secured in place by a chin strap which extends under the jaw of the wearer. Conventionally, the strap passes under the mandibular bodies, in the notches just forward of the angle of the jaw, and across the fleshy upper part of the throat between the two sides of the jawbone. The chin strap must be fairly tight in order to properly secure the shell in position, and consequently the tension causes the strap to press upwardly against the fleshy tissues and muscles underlying the wearer's tongue, referred to hereinafter as the "hypoglossal area". Consequently, this makes it difficult for the person to extend their jaw, and also tends to force the tongue upwardly towards the roof of the mouth, constricting the oral cavity. This, in turn, restricts the person's ability to breath through the mouth during heavy exertion, such as while pedaling a bicycle uphill or in competition.

Chin straps are conventionally constructed of a heavy, flexible fabric material, such as nylon webbing, which tends to stretch straight across between the sides of the jawbone when tensioned. Various cushioning attachments are known for such chin straps, including those shown in U.S. Pat. Nos. 4,856,119 (Häberle), 5,500,951 (Marchello), and 5,504,945 (Purnell), but all such known cushions are constructed of highly flexible material and consequently do nothing to relieve the upward pressure against the hypoglossal area and therefore do not alleviate the breathing problem discussed above.

Accordingly, there exists a need for a chin strap assembly for bicycle helmets and other helmets and headgear, in which the upward pressure against the hypoglossal area caused by the tension of the strap is reduced or eliminated, so as to permit freer breathing through the oral cavity. Further, there is a need for such a chin strap assembly which is comfortable to wear and avoids chafing of or digging into the wearer's neck and skin. Still further, there is a need for such an assembly which is easy to install and/or remove, as desired. Still further, there is a need for such an assembly which is inexpensive to manufacture and therefore may be offered at a reasonable price to the consumer, and which is durable and longwearing in use.

SUMMARY OF THE INVENTION

The present invention has solved the problems cited above, and is a chin strap assembly for placement under the jaw of the wearer. Broadly, the chin strap assembly comprises: (a) a flexible strap member configured to extend under the wearer's jaw, (b) an elongate, semi-rigid, resiliently flexible support member having first and second upwardly extending end portions which are configured to be positioned beneath first and second sides of the wearer's jawbone, and a downwardly arched center portion which is configured to extend beneath the soft-tissue hypoglossal area of the jaw between the sides of the jawbone, and (c) attachment means for mounting the semi-rigid support member to the strap member of the helmet, so that (d) when the strap member is placed under the jaw and tension is applied thereto, the downwardly arched center portion of the support member relieves the hypoglossal area from upward pressure generated by the tension on the strap member, and the upward pressure is transmitted into the first and second sides of the jawbone through the upwardly extending end portions of the support member. The support member may comprise an elongate, unitary strip formed of a semi-rigid, resiliently flexible material, such as molded plastic or rubber material.

Each end portion of the support member may comprise an outwardly flared end area which forms a generally horizontal contact patch for bearing against an underside of the wearer's jaw beneath the jawbone. Each end portion may further comprise a downcurved tip portion which extends downwardly from the generally horizontal contact patch so as to avoid digging into the wearer's jaw under the upward pressure. The end portion may still further comprise an enlarged bead portion at the end of the tip portion and extending substantially the full width of the support member, the bead portion having a smoothly radiused outer surface so as to avoid abrasion of the strap member on the wearer's skin. Preferably, the edges of the support member are smoothly radiused as well.

Preferably, the downwardly arched center portion of the support member extends downwardly below the generally horizontal contact patches by a distance which is sufficient to accommodate the hypoglossal area of the wearer's jaw, with the hypoglossal area in a distended configuration so as to open the wearer's oral cavity for breathing and with the contact patches bearing upwardly against the first and second sides of the jawbone. Also, the downwardly arched center portion of the support member preferably comprises a central, lowermost portion which is offset forwardly from the horizontal contact patches, by a distance which is sufficient to position the lowermost portion of the support member forwardly of the wearer's larynx when the contact patches are bearing against the notches in the jawbone forward of the mandibular angle.

The semi-rigid, resiliently flexible support member may have a first, relatively narrower width between its end portions when in a relaxed configuration, and a second, relatively wider width to which the support member extends when compressed by the upward pressure of the strap member, so that the support member resiliently biases the strap member inwardly against the wearer's cheeks and under the first and second sides of the jawbone.

The attachment means for mounting the semi-rigid support member to the flexible strap member may comprise a resiliently elastic tubular sleeve member configured to fit over the support member and the flexible strap member, so as to retain the support member in place against the strap member at a selected position thereon. Preferably, the elastic sleeve member is formed of a resiliently compressible material for cushioning the support member against the wearer's jaw. The tubular sleeve may be formed of an elastomeric fabric material, such as a neoprene or rubber cushioning material having a surface layer which configured to wick sweat and other moisture away from the wearer's jaw.

Also, the attachment means may comprise a fabric sleeve member which is configured to wrap over the support member and strap members, and which has closure means so that the sleeve member retains the support member in place against the strap member at the selected position along the strap member, the closure means preferably being a zipper mechanism. The attachment means may also comprise a tubular fabric sleeve member which is configured to hold a support member therein, and means for attaching the tubular fabric sleeve member to the flexible strap member, such as a plurality of band members mounted to the fabric sleeve for wrapping around the strap member. Furthermore, the attachment means may comprise bonding means for permanently mounting the support member to one side of the strap member, or the attachment means may be at least one layer of material of the strap member, the support member being substantially enclosed within the flexible strap member.

DETAILED DESCRIPTION

Figure 1:
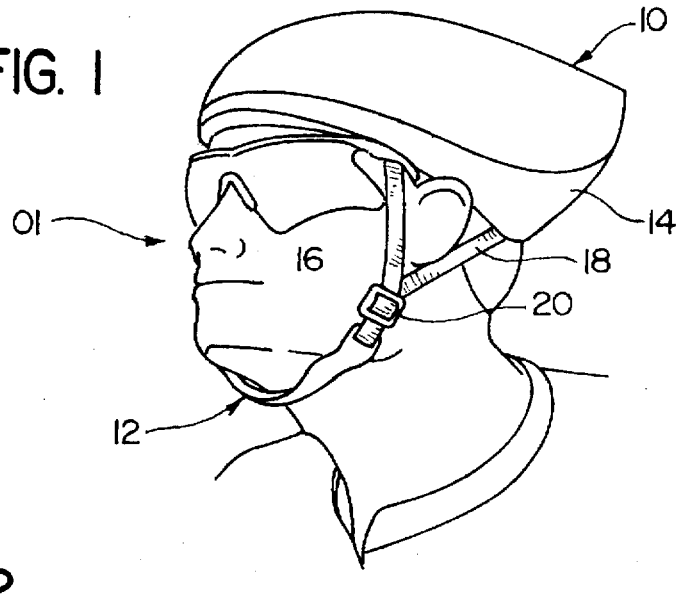
FIG. 1 is a perspective view of the head and neck of a person wearing a bicycle helmet having a chin strap assembly in accordance with the present invention, this showing a manner in which the chin strap assembly alleviates upward pressure against the hypoglossal area of the person's throat so as to permit freer breathing through the mouth.

FIG. 1 shows the head and shoulders of a person 01 wearing a bicycle helmet 10 which incorporates a chin strap assembly 12 in accordance with the present invention. As used in this description and the appended claims, the term "helmet" includes all forms of protective headgear and other types of headwear which are retained by a strap which passes under the wearer's jaw.

The helmet shell 14 itself is of generally conventional construction, and is provided with an elongate, flexible strap member 16 formed of nylon webbing (or other suitable material) which extends under the person's jaw, an equalizing strap 18 which passes behind the ear on either side of the person's head, and a buckle mechanism 20 for securing the ends of the strap together. Accordingly, it will be understood that the support and cover members of the chin strap assembly of the present invention may be provided as an original part of a helmet assembly, or may be provided as an accessory or after-market item which can be retrofitted to an otherwise conventional helmet.

Figure 2:
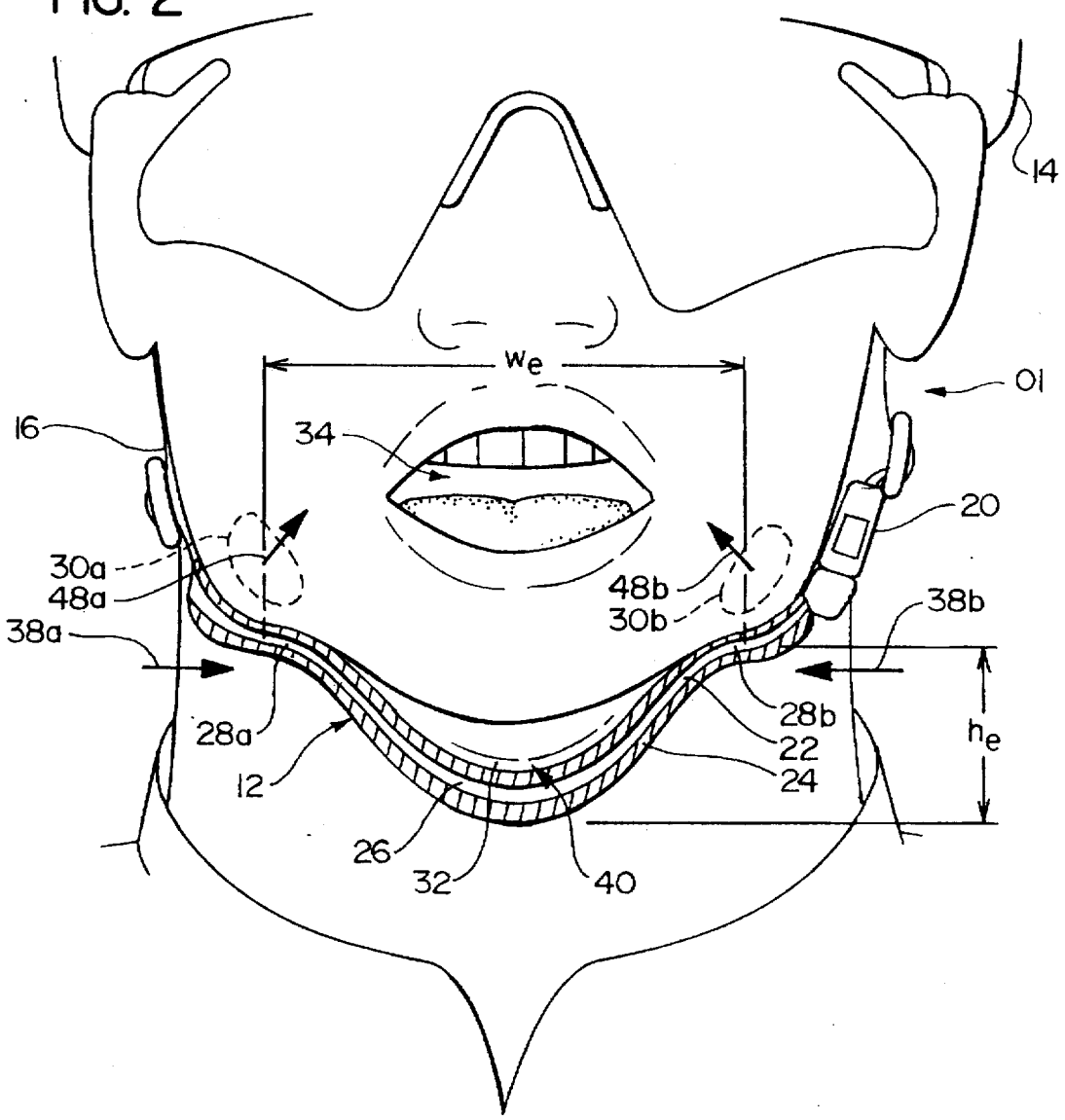
FIG. 2 is a front, elevational view of the head/neck and chin strap assembly of FIG. 1, with a cross-section being taken longitudinally through the strap assembly so as to show the semi-rigid support member and elastic cover member thereof in greater detail.

As can better be seen in the frontal view of FIG. 2, the strap assembly 12 in accordance with the present invention includes a flexible, semi-rigid support member 22 which fits against the upper surface of the web strap 16, in the area where this crosses under the person's jaw, and a sleeve member 24 which fits over the strap and support member so as to hold the two together and also minimize chafing against the wearer's skin. As can be seen, the support member 22 has a downwardly arched central section 26 which is configured to be positioned beneath the hypoglossal area in the middle of the person's lower jaw, and upwardly and outwardly flared end portions 28*a*, 28*b* which are configured to be positioned directly beneath the left and right sides of the jawbone (the left and right mantibular bodies), as indicated by broken line images 30*a*, 30*b*. Thus, the upward tension on the strap member 16 is transferred by the end portions of the support member into the hard bone on either side of the jaw, while the downwardly arched center portion 26 alleviates any upward pressure against the soft tissues of the hypoglossal region 32. This in turn prevents the person's tongue from being forced up into the oral cavity, thereby leaving an open oral passage 34 for unrestricted breathing during exertion.

Figure 3A:
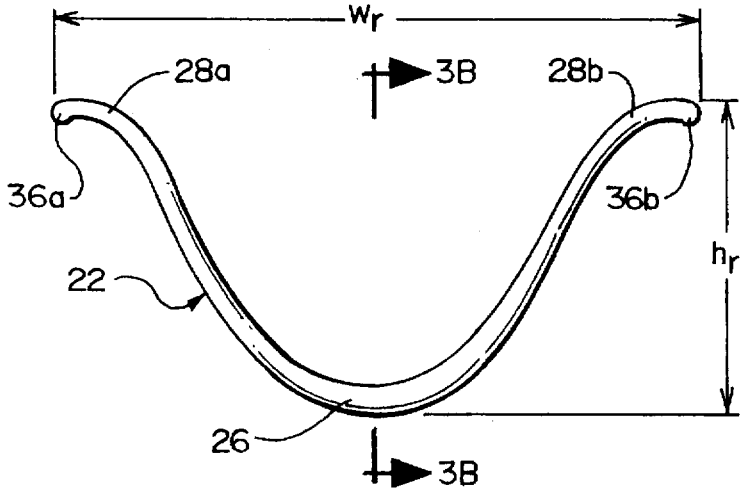
FIG. 3A is a front elevational view of the semi-rigid, flexible support member of the chin strap assembly in accordance with the present invention, as shown in FIGS. 1–2.
Figure 3B:
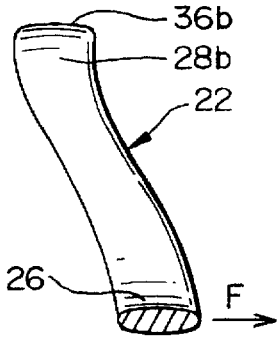
FIG. 3B is a side view of a cross-section taken through the midpoint of the support member, along line 3B—3B shown in FIG. 3A.
Figure 3C:
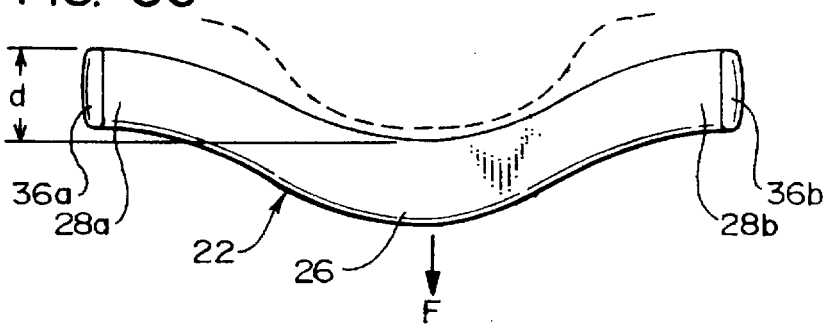
FIG. 3C is a top plan view of the support member shown in FIGS. 3A—3B.

FIGS. 3A–3C show the flexible, semi-rigid support member 22, separated from the strap assembly and in its relaxed configuration. As can be seen, the support member preferably has the form of an elongate, downwardly bowed strip, somewhat flattened in the horizontal plane (see the plan view shown in FIG. 3C). The support member may be formed of any suitable, semi-rigid, resiliently flexible material having a high degree of memory and resistance to fracture, such as a suitable plastic or metal strip. For example, polyurethane or low-density polyethylene, or semi-rigid, soft-durometer polypropylene, PVC or other polyolefin plastics, are eminently suitable for this purpose, although it will be understood that a great variety of other suitable materials including various plastics, Teflon™, reinforced rubber products, metals, and fiberglass/composite (e.g., carbon fiber/resin) materials, will occur to those skilled in the relevant art. Also, in some embodiments, heat moldable materials may be employed so that the support member can be deformed somewhat to meet the specific requirements of an individual wearer, by heating material using a heat gun or other source, for example.

As was noted above, the support member has a downwardly arched center portion 26 and end portions 28*a*, 28*b*. The end portions are flared outwardly in a generally horizontal direction and are slightly downcurved at their tips, to provide comfortable surfaces or contact patches for bearing against the underside of the wearer's jaw, and to eliminate any possibility of the ends "digging" into the wearer's skin under tension or in the event of an accident. To further eliminate any possibility of the wearer being gouged by the ends of the support member, and also to reduce wear against the strap and cover member, the end portions are also preferably provided with bulb-like bead structures 36*a*, 36*b* at their tips which extend the full width of the strip and have smoothly radiused outer surfaces. Also, as can be seen in the cross-sectional view of FIG. 3B, the edges of the strip itself are also preferably smoothly radiused, again for enhanced comfort and wear characteristics.

In the relaxed configuration which is shown in FIG. 3A, the support member 22 has a total width $w_r$ which is somewhat less than the total width $w_e$ which the support member assumes when the web strap 16 is tensioned across the bottom of the wearer's jaw, forcing the downwardly arched center portion upwardly and the two end portions outwardly to the configuration which is shown in FIG. 2. The high degree of resilience or memory of the support member, however, biases the end portions 28*a*, 28*b* back towards one another when in the extended configuration (i.e., whenever the end portions are spread beyond the relaxed width $w_r$), thus drawing the sides of the strap 16 inwardly against the person's cheeks and under the right and left sides 30*a*, 30*b* of the jawbone, in directions indicated by arrows 38*a*, 38*b* in FIG. 2. The deformation of the support member reduces the overall height of the arched center section somewhat, from the height $h_r$ shown in FIG. 3A, to the decreased height $h_e$ which is shown in FIG. 2; however, the relaxed height $h_r$ is preferably selected relative to the expanded width and resilient characteristics of the material so that even when the support member is spread apart to its fullest extent, a gap 40 will still remain between the upper surface of the strap assembly 12 and the lower surface of the hypoglossal area 32. Although the exact size of the gap 40 may vary somewhat from one embodiment to another, it is preferable that this be at least large enough to accommodate the full expansion of the person's upper throat and mouth during hard breathing; a gap of about one finger's thickness when the mouth is closed is a useful rule of thumb for fitting many persons.

Also, as can be seen in FIG. 3B, the support member 22 does not arch downwardly in a vertical plane, but instead is curved downwardly and forwardly at its center portion 26, in the forward direction indicated by the arrow "F". As can be seen in FIG. 3C, this forward curvature offsets the center portion 26 of the support member forwardly from the end portions 28*a*, 28*b* by a predetermined distance "d". This distance "d" is selected to accommodate the area of the wearer's larynx, as indicated by broken line image 42, while permitting the end portions 28*a*, 28*b* to be firmly located in the notches forward of the mandibular angles.

Although the exact dimensions of the support member are somewhat anthropometric in nature, dimensions which may be suitable to fit a large percentage of the population as a "medium size" when the member is formed of semi-rigid polypropylene may be as follows:

| | |
|---|---|
| $w_r$ | approx. 3½ inches |
| $h_r$ | approx. 1¾ inches |
| d | approx. ½ inch |
| radius of central downward arch section | approx. 1¼ inch |
| length of flared end portions | approx. ½ inch |
| width of strip | approx. ⅜ inch |

-continued

| | |
|---|---|
| thickness of strip | approx. ⅛ inch |
| total length of strip (flattened out) | approx. 5½ inches |

As was noted above, the above dimensions may be suitable for providing a "medium size" support member which is suitable for a large percentage of the population, both male and female. However, it will be understood that both smaller and larger sizes may be provided as necessary to accommodate a more comprehensive segment of the population, and that furthermore the support member may be custom fitted to a wearer based on individual measurements, either at the time of original manufacture, or by adjusting or changing its original shape using heat (as described above) or other adjustment means.

Figure 4A:
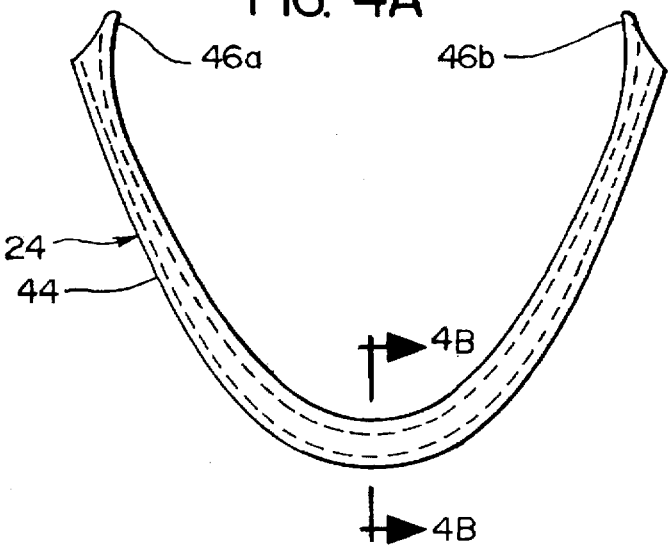
FIG. 4A is a front elevational view of the elastic sleeve cover member which extends over the support member shown in FIGS. 3A–3C and secures this to the flexible webbing of the main helmet strap.
Figure 4B:
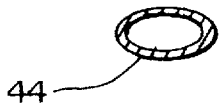
FIG. 4B is a cross-sectional view of the sleeve cover.

As was noted above, the strap assembly 12 also includes a cover member 24 which attaches or secures the support member to the flexible strap member. In the embodiment which is illustrated in FIGS. 1–2, the cover member 24 is formed by an elastomeric sleeve member 44 having a tubular cross-section (see FIG. 4B) for receiving both the semi-rigid support member and the flexible strap member in close-fitting engagement therewith. The tubular elastomeric sleeve thus forms a stretch wrap which holds the semi-rigid support member in place in the selected position along the strap member 16, and also provides a cushioning surface for the comfort of the wearer.

The stretch wrap cover may advantageously be formed of a ⅛ inch or ¼ inch thick cellular neoprene rubber material having a nylon or polypropylene mesh/fabric outer layer, such as that which is commonly available for wetsuit or wetsuit patch material. This type of material not only provides a cushioning layer, but also wicks moisture away so as to keep the area dry from sweat and thereby prevent irritation. However, other suitable elastomeric materials (e.g., soft nylon fabric or webbing) may be employed. The sleeve member 44 is sized to have a total length somewhat greater than that of its support member and is cut so as to have elongate upper lip portions 46*a*, 46*b* at its ends, so as to obviate any possibility of the rigid support member coming into contact with and rubbing against the wearer's skin. Another important advantage which is provided by the sleeve attachment, as opposed to fixedly mount the support member to the flexible strap, is that in the event of an accident or other impact, the support member can simply slide to one side as necessary, rather than pressing or digging into the wearer's jaw or neck.

To install the assembly, the semi-rigid support member is positioned on top of the flexible strap member 16 in the position shown in FIG. 2, and then the ends of the support and strap members are held together and threaded into one end of the elastomeric sleeve member 44, with the lip portions 46 facing in an upward direction. The sleeve member is then stretched and pulled into place so that it completely covers the support member as shown in FIG. 2. Thus installed, the sleeve member holds the support member tightly in place against the web strap member, so as to eliminate any undesired movement or slippage of the support member. As noted above, the elastomeric sleeve member also provides a comfortable, cushioning surface where the assembly bears against the underside of the wearer's jaw.

In use, the strap assembly is passed under the wearer's jaw in the same general area as a conventional chin strap, so that the ends of the support member are positioned directly below the two sides 30*a*, 30*b* of the jawbone, as shown in FIG. 2. The buckle assembly is then connected, with the strap member being synched up if additional tension is required to keep the helmet firmly in place. As this is done, the support member is spread apart slightly as described above to the width $w_e$, and in response pulls inwardly on the strap member in the directions indicated by arrows 38*a*, 38*b*, so as to tighten the strap along the wearer's cheeks and under the edges of the jawbone. The force generated by the tension of the chin strap, and by the spring force of the support member, is thus borne by the sides of the jawbone in a generally upward and somewhat inward direction, as indicated by arrows 48*a*, 48*b* at FIG. 2. The downwardly arched center portion 26 of the support member, in turn, acts as a "bridge" between the two pressure areas, across the lower surface of the fleshy part of the hypoglossal area, allowing the wearer to maintain the open oral passage for breathing, as described above.

Figure 5:
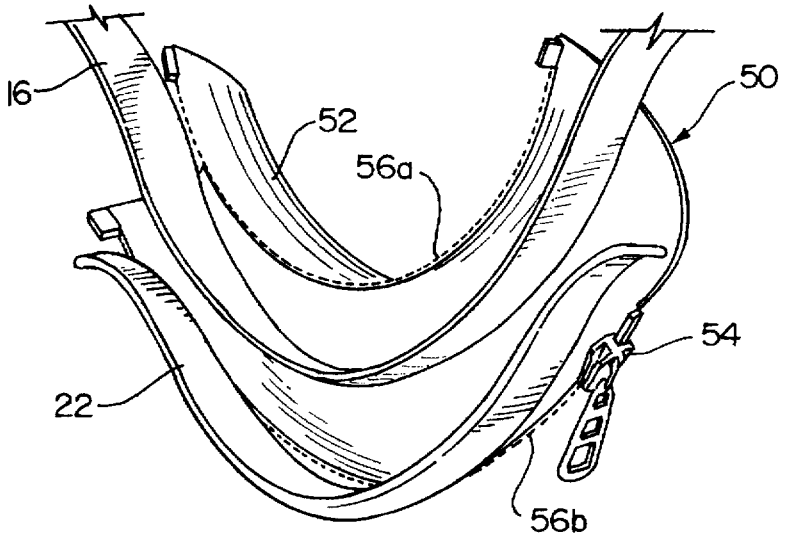
FIG. 5 is an elevational view of a chin strap assembly in accordance with a second embodiment of the present invention, in which the support member is secured to the helmet strap by a zip-up sleeve, as opposed to the elastomeric sleeve member which is shown in FIG. 4A.
Figure 6:
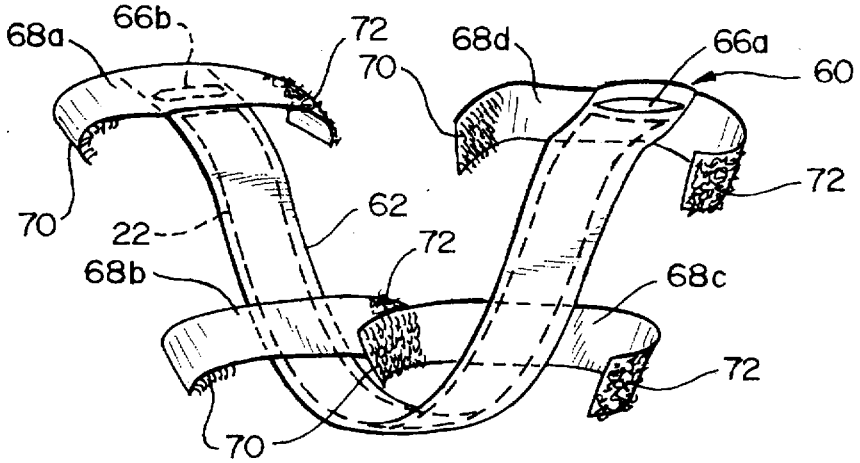
FIG. 6 is perspective view of a chin strap assembly in accordance with another embodiment of the present invention, in which there is a fabric sleeve into which the support member is threaded, and then attached to the main helmet strap by Velcro™ or other hook-and-loop fabric strips which encircle the sleeve and helmet strap.

FIGS. 5 and 6 show cover members in accordance with other embodiments of the present invention. In particular, FIG. 5 illustrates an embodiment in which the cover member is formed as a zip-up sleeve formed out of a fabric which may or may not have an elastomeric component. As can be seen, the zip-up type sleeve 50 comprises an elongate fabric panel 52 having one-half of a zipper 54 sewn or otherwise mounted along each of its long edges 56*a*, 56*b*. In use, the support member 22 is placed atop the flexible strap member 16 in the desired position, in the same manner as previously described, and then the sleeve 50 is wrapped over the two members and zipped closed, the width of the fabric panel 52 being selected so that the sleeve member 50 fits tightly around the strap and support members. This embodiment enjoys the particular advantage of easy removal for cleaning. Also, the zipper 54 is preferably fabricated of lightweight plastic, for reasons of both weight and comfort. Other closure mechanisms, such as snap fittings, for example, may be used in place of or in combination with the zipper mechanism which is shown in FIG. 5.

FIG. 6 shows a fabric cover member 60 in accordance with another embodiment of the present invention, in which there is a flat, tubular fabric sleeve portion 62 which is formed by stitching or otherwise bonding together the edge or edges of a fabric strip or strips. Openings 66*a*, 66*b* are left at the ends of the fabric sleeve for insertion of the semi-rigid support member, as indicated by the broken line image 22. Several short fabric bands or strips 68 are sewn or otherwise attached to the upper surface of the fabric tube member so that their ends 70, 72 extend outwardly on either side thereof. As is shown in FIG. 6, each of the strips bends downwardly around the tubular fabric sleeve, with a first end 70 having the hook layer of a Velcro™ or other hook-and-loop materialon its lower surfaceand the opposite end 72 having the loop layer of the material on its upper surface. Accordingly, with the semi-rigid support member inserted into the sleeve as shown in FIG. 6, the support and cover members can be placed atop the strap member and then secured in place by wrapping the bands tightly around the strap member and pressing their ends together. This embodiment also has the advantage of quick attachment and removability from the strap member, and furthermore allows the helmet buckle to be positioned along the length of the sleeve, between adjacent strips 72. The loose end of the strap can be held down by the band, without the buckle pinching or pressing against the wearer's skin.

The fabrics which are used for the cover members in the embodiments shown in FIGS. 5 and 6 are again preferably of a cushioning type which wicks sweat and other moisture away from the wearer's skin. Also, although the embodiment which is shown in FIG. 6 is provided with four bands or strips, one at each end and one on either side of the bottom of the hypoglossal area, it will be understood that these may be varied in number, size, position, and shape as is desired for a particular application.

Figure 7:
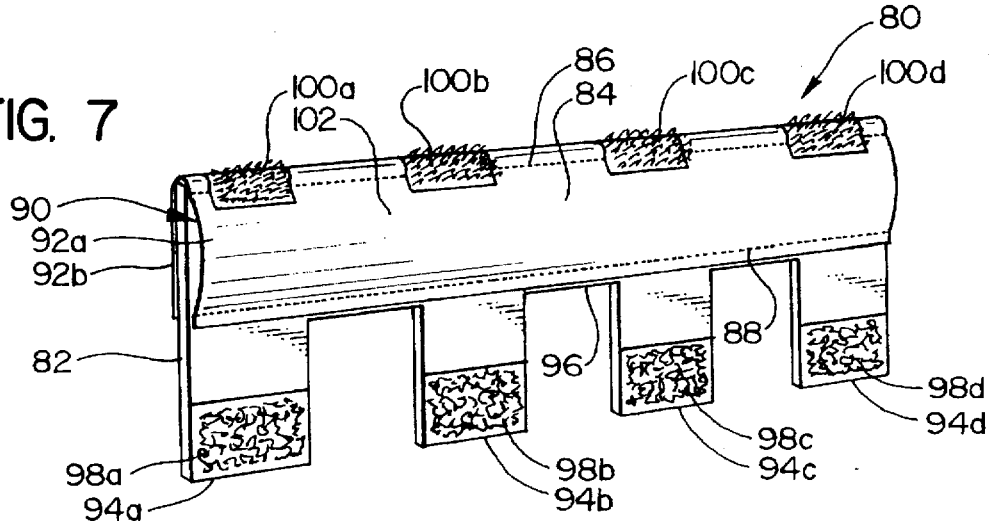
FIG. 7 is a perspective view of the sleeve portion of a chin strap assembly in accordance with another embodiment of the present invention, in which a first layer of cushioning material has a fabric layer sewn thereto so as to form a tubular sleeve for holding the support member, and one or more portions of the cushioning layer depend from the tubular sleeve section for wrapping around the helmet strap.

FIG. 7, in turn, shows a fabric cover member 80 in accordance with yet another embodiment of the present invention, in which there is a first layer 32 of cushioning material (e.g., ⅛ inch cellular neoprene material, as described above) with a second layer of thinner fabric 84 folded over the upper edge of this and stitched along its upper and lower edges at 86, 88 so as to form an open-ended sleeve area 90 for receiving the semi-rigid support member. Because the layer 84 of thin but comparatively tough fabric extends over both sides of the cushioning material, so as to form front and back panels 92*a*, 92*b*, this construction obviates any possibility of the stitching tearing or pulling out of the comparatively soft neoprene rubber layer.

A plurality (e.g., four, in the embodiment which is illustrated) tab portions 94*a–d* of the cushioning layer 82 extend downwardly from the lower edge 96 of the tubular sheath area, and are provided with patches 98*a–d* of the "loop" layer of Velcro™ or other hook-and-loop fabric on their ends. Corresponding patches 100*a–d* mounted proximate the upper edge of the sleeve portion, in vertical alignment with the downwardly extending tab portions 94. Accordingly, the assembly can be completed by inserting the semi-rigid support member into the sleeve area 90 and positioning the strap member against the front panel area 102 of the sleeve portion, and then wrapping the tab members 94*a–d* over the strap member and securing them in place by pressing their ends together in a manner similar to the embodiment which is shown in FIG. 6.

The embodiment which is shown in FIG. 7 has certain advantages in terms of economy of manufacture and providing cushioning for the wearer. Also, as with the embodiment described in the preceding section, the exact number and positions of the tab members 94 may vary somewhat from the arrangement which is shown in FIG. 7.

The strap assembly of the present invention has been illustrated herein primarily with reference to embodiments in which the semi-rigid support member is detachably mounted to an otherwise conventional strap member of a helmet. It will be understood, however, that in some embodiments the support member may be temporarily or permanently mounted on (as, for example, by snaps or layers of Velcro™ or other hook-and-loop material, or by gluing, stitching or otherwise bonding to the strap member), or enclosed within the strap member itself, and furthermore that the cushioning cover may only be on or extend over the upper surface of the support member, or otherwise not completely encircle the support and strap members. Still further, in some embodiments the support member may be formed as an integral part of the support member, or there may be strap segments which are attached to the ends of the support member, rather than a strap which extends continuously across the bottom of the jaw. Accordingly it is to be recognized that various alterations, modifications, and/or additions may be introduced into the constructions and arrangements of parts described above without departing from the spirit or ambit of the present invention as defined by the appended claims.

What is claimed is:

1. A chin strap assembly for placement under the jaw of a wearer, said chin strap assembly comprising:

a flexible strap member configured to extend under said wearer's jaw;

an elongate semi-rigid, resiliently flexible support member having first and second upwardly-extending end portions which are configured to be positioned beneath first and second sides of said wearer's jawbone and a downwardly arched center portion which is configured to extend beneath the soft tissue, hypoglossal area of said jaw between said first and second sides of said jawbone; and attachment means for mounting said semi-rigid support member to said flexible strap member;

so that when said strap assembly is placed under said jaw and a tension is applied to said strap member, said downwardly arched center portion support member relieves said hypoglossal area from upward pressure generated by said tension so said strap member and said upward pressure is transmitted into said first and second sides of said jawbone through said upwardly extending end portions of said support member.

2. The chin strap assembly of claim 1, wherein said support member comprises:

an elongate unitary strip formed of a semi-rigid, resiliently flexible material.

3. The chin strap assembly of claim 2, wherein said semi-rigid, resiliently flexible material is molded plastic material.

4. The chin strap assembly of claim 2, wherein each said end portion of said support member comprises:

an outwardly-flared end area which forms a generally horizontal contact patch for bearing against an underside of said wearer's jaw beneath said jawbone.

5. The chin strap assembly of claim 4, wherein each said end portion of said support member further comprises:

a downcurved tip portion which extends downwardly from said generally horizontal contact patch so as to avoid digging into said wearer's jaw under said upward pressure.

6. The chin strap assembly of claim 5, wherein each end portion further comprises:

an enlarged bead portion at the end of said tip portion and extending substantially the full width of said support member, said bead portion having a smoothly radiused outer surface so as to avoid abrasion of said strap member or digging into said wearer's skin.

7. The chin strap assembly of claim 4, wherein said downwardly arched center portion of said support member extends downwardly below said generally horizontal contact patches by a distance which is sufficient to accommodate said hypoglossal area of said wearer's jaw, with said hypoglossal area in a distended configuration so as to open said wearer's oral cavity for breathing and with said contact patches bearing against said jaw beneath said first and second sides of said jawbone.

8. The chin strap assembly of claim 7, wherein said downwardly arched center portion of said support member comprises:

a central, lowermost portion which is offset forwardly from said generally horizontal contact patches by a distance which is sufficient to position said lowermost portion of said support member forwardly of said wearer's larynx with said contact patches bearing against notches which exist in said jawbone forward of the mandibular angle.

9. The chin strap assembly of claim 4, wherein said semi-rigid, resiliently flexible support member has a first, relatively narrower width between said end portion when in a relaxed configuration and a second, relatively wider width to which said support member extends when compressed by said upward pressure of said strap member, so that said support member resiliently biases said flexible strap member inwardly against said wearer's cheeks and under said first and second sides of said jawbone.

10. The chin strap assembly of claim 2, wherein said attachment means for mounting said semi-rigid support member to said flexible strap member comprises:

a resiliently elastic tubular sleeve member configured to fit over said support member and said flexible strap member so as to retain said support member in place against said strap member at a selected position along said strap member.

11. The chin strap assembly of claim 10, wherein said elastic sleeve member is formed of a resiliently compressible material for cushioning said support member against said wearer's jaw.

12. The chin strap assembly of claim 11, wherein said resiliently elastic sleeve member has an overall length which is greater than an overall length of said support member so as to fully cover said support member.

13. The chin strap assembly of claim 12, wherein said elastic sleeve member further comprises:

a tubular sleeve formed of an elastomeric fabric material.

14. The chin strap assembly of claim 13, wherein said elastomeric fabric material comprises:

a polypropylene-neoprene cushioning material which is configured to wick sweat and other moisture away from said jaw of said wearer.

15. The chin strap assembly of claim 2, wherein said attachment means for mounting said support member to said flexible strap member comprises:

a fabric sleeve member-configured to wrap over said support member and said flexible strap member and having closure means so that said sleeve member retains said support member in place against said strap member at a selected position along said strap member.

16. The chin strap assembly of claim 15, wherein said closure means of said fabric sleeve member comprises a zipper mechanism.

17. The chin strap assembly of claim 2, wherein said attachment means for mounting said semi-rigid support member to said flexible strap member comprises:

a tubular fabric sleeve member configured to hold said support member therein; and means for attaching said tubular fabric sleeve member to said flexible strap member.

18. The chin strap assembly of claim 17, wherein said means for attaching said tubular fabric sleeve member to said flexible strap member comprises:

a plurality of band members mounted to said fabric sleeve for wrapping around said strap member.

19. The chin strap assembly of claim 2, wherein said attachment means for mounting said semi-rigid support member to said flexible strap member comprises:

bonding means for permanently mounting said support member to one side of said strap member.

20. The chin strap assembly of claim 2, wherein said attachment means for mounting said semi-rigid support member to said strap member comprises:

at least one layer of material of said strap member, said support member being substantially enclosed within said flexible strap member.

* * * * *